US006698130B2

(12) United States Patent
Yang et al.

(10) Patent No.: US 6,698,130 B2
(45) Date of Patent: Mar. 2, 2004

(54) HOLDING DEVICE FOR TRIGGER'S PROTECTION BOW

(76) Inventors: Yu-Hsi Yang, 2F,No.1,Aly.4,Ln.187, YungJi Rd., Taipei (TW); Chao-Chi Huang, 11F-2,No.250,Sec.4,JungShiau E.Rd., Daan Chiu, Taipei (TW)

( * ) Notice: Subject to any disclaimer, the term of this patent is extended or adjusted under 35 U.S.C. 154(b) by 0 days.

(21) Appl. No.: 10/237,368

(22) Filed: Sep. 9, 2002

(65) Prior Publication Data

US 2003/0221353 A1 Dec. 4, 2003

(30) Foreign Application Priority Data

May 31, 2002 (TW) ..... 91207983 U

(51) Int. Cl.[7] ..... F41G 1/32
(52) U.S. Cl. ..... 42/146; 362/110
(58) Field of Search ..... 42/71.02, 72, 73, 42/90, 113, 114, 115, 117, 142, 146; 362/110, 113, 114

(56) References Cited

U.S. PATENT DOCUMENTS

| | | | | | |
|---|---|---|---|---|---|
| 5,282,594 | A | * | 2/1994 | Huang | 42/100 |
| 5,581,898 | A | * | 12/1996 | Thummel | |
| 5,758,448 | A | * | 6/1998 | Thummel | 362/114 |
| 5,983,548 | A | * | 11/1999 | Ludaescher | 42/90 |
| 6,393,752 | B1 | * | 5/2002 | Oliver et al. | 42/146 |
| 2002/0100202 | A1 | * | 8/2002 | Lin et al. | 42/114 |

FOREIGN PATENT DOCUMENTS

CH 654 655 A5 * 2/1986

* cited by examiner

*Primary Examiner*—Stephen M. Johnson
(74) *Attorney, Agent, or Firm*—Raymond Sun

(57) ABSTRACT

A holding device is removably attached to the protection bow of a pistol. The holding device has a main body, a fixing portion, an abutting portion that is pivotably coupled to the main body, and an accommodation space defined between the fixing portion and the abutting portion for receiving the protection bow.

10 Claims, 5 Drawing Sheets

HOLDING DEVICE FOR TRIGGER'S PROTECTION BOW

BACKGROUND OF THE INVENTION

1. Field of the Invention

The invention relates to pistol accessories, and in particular, to a holding device for the protection bow of a trigger on a pistol.

2. Description of the Prior Art

The Chinese invented the gunpowder in ancient times. For example, tracing back to the Tang Dynasty (around 1,000 AD), there were already records about gunpowder. At beginning, the alchemist discovered that a mix of saltpeter, sulfur, and charcoal would produce a powder capable of generating a strong flame, which was called gunpowder. Except for the application of its explosive force and combustion force, taking iron sand and stone as projectiles for smashing and wounding targets made simple firearm and cannon. The gunpowder was used extensively for warfare during the Sung Dynasty, and was then brought to the western world by Mongol conquest of western lands. In modern times, mankind has further applied gunpowder for use with shooting arms, such as pistols, rifles, and machine guns, among others.

The modern shooting arms described hereinabove are all equipped with a trigger, which activates an anvil to hit a firing pin, which then directly hits the base gunpowder to further produce a flame flowing through the pipe to ignite the gunpowder. In order to prevent inadvertent actuation of the trigger, a trigger is provided with a protection bow along the outer edge of the trigger that functions to prevent the trigger from being inadvertently actuated. In addition, to enable the shooter to hit a target more accurately, modern shooting arms are further equipped with an indicating device (for example, a sniper mirror, a sniper scope, a laser gun-sight, etc.) to improve a shooter's aim. The indicating device is typically provided on a holding device that is removably connected to the protection bow of a trigger.

FIG. 1 is a side view of a conventional holding device showing how the holding device is removably attached to the protection bow of a trigger. The holding device has a main body 1, which has a plate 12 that abuts against one side of the protection bow 8. An adjusting-and-fixing portion 13 and an insetting-and-abutting portion 14 are provided on two opposing sides of the plate 12, with an accommodation space 15 formed between the adjusting-and-fixing portion 13 and the insetting-and-abutting portion 14 for receiving the protection bow 8. Since the shape of the inner surface of the insetting-and-abutting portion 14 (i.e., the surface on the side of the accomodation space 15) is the same as the shape of the protection bow 8, the protection bow 8 can be aligned and abutted against the insetting-and-abutting portion 14 to form a form-fitting contact. Two threaded bolts 16 can be threadably extended through corresponding bores in the adjusting-and-fixing portion 13 and made to extend into the accommodation space 15 to contact the protection bow 8, thereby securing the protection bow 8 tightly inside the accomodation space 15.

The conventional holding device works effectively when the configuration of the adjusting-and-fixing portion 13 and the insetting-and-abutting portion 14 correspond to the configuration of the protection bow 8. However, not all protection bows 8 are provided in the same configuration, so the only way to achieve the desired tight fit of the protection bow 8 in the accomodation space 15 would be to provide customized holding devices for each different model of protection bow 8. Otherwise, if a holding device is secured to a protection bow 8 that has a different non-corresponding shape, then the protection bow 8 cannot be securely held inside the accomodation space 15. In particular, the contact between the insetting-and-abutting portion 14 and the protection bow 8 would become point contact, thereby creating a relative sliding motion when the insetting-and-abutting portion 14 is abutted against the protection bow 8.

Thus, there still remains a need for a holding device that can be tightly secured to protection bows of different shapes.

SUMMARY OF THE DISCLOSURE

It is an object of the present invention to provide a holding device that can be tightly secured to protection bows of different shapes.

In order to accomplish the objectives of the present invention, the present invention provides a holding device that can removably attached to the protection bow of a pistol. The holding device has a main body, a fixing portion, an abutting portion that is pivotably coupled to the main body, and an accommodation space defined between the fixing portion and the abutting portion for receiving the protection bow.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The holding device for a protection bow according to the present invention has an insetting-and-abutting portion that can be pivoted about a pivot axis to adapt to protection bows that have different shapes. When the protection bow of a trigger is placed into an accommodation space inside the holding device, four connection points are provided to tightly secure the holding device to the protection bow: two abutment points of a convex surface of the insetting-and-abutting portion that abut against the protection bow, and two bolts that can be adjusted to extend into the accommodation space to exert a force on the protection bow.

Figure 1:
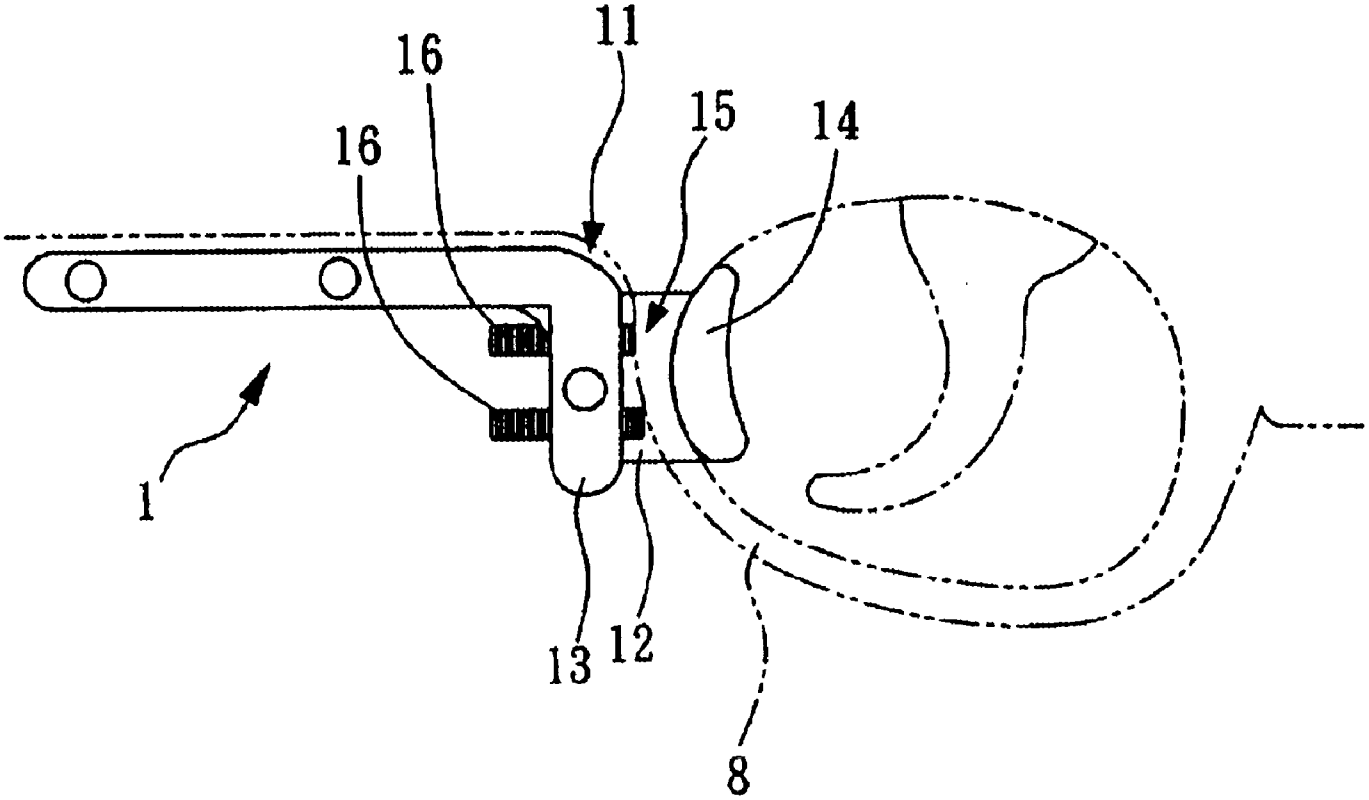
FIG. 1 (PRIOR ART)
FIG. 1 is a side view illustrating how a conventional holding device is secured to a protection bow of a trigger.
Figure 2:
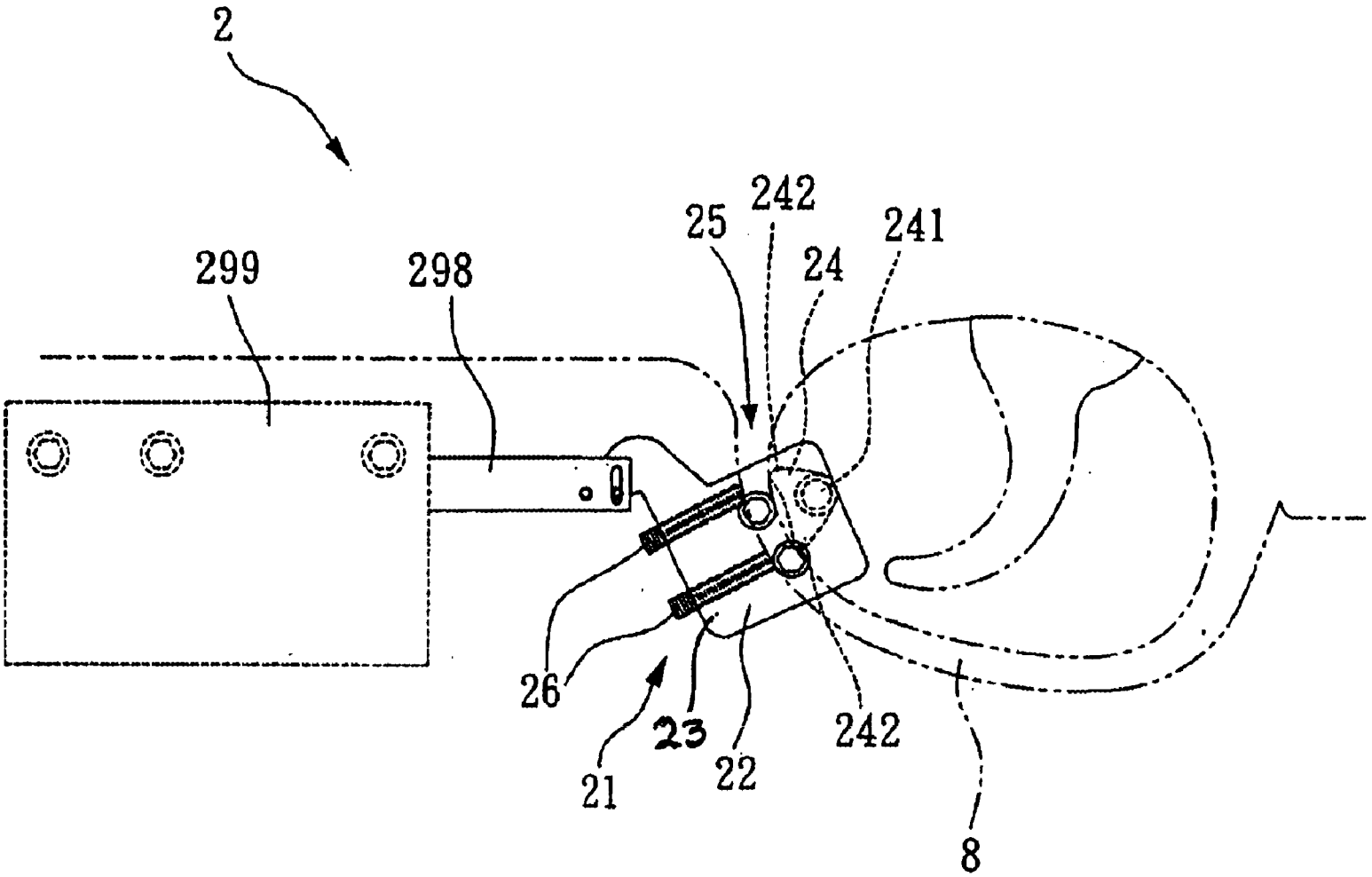
FIG. 2 is a side view illustrating how a holding device according to one embodiment of the present invention is secured to a protection bow of a trigger.

FIG. 2 illustrates one embodiment of a holding device 2 of the present invention. The holding device 2 has a main body 21, which includes a plate 22 that is positioned against one lateral side surface of the protection bow 8 (shown in phantom) of a trigger. An adjusting-and-fixing portion 23 (referred to hereinafter as the "fixing portion 23") and an insetting-and-abutting portion 24 (referred to hereinafter as the "abutting portion 24") are provided on the front end and the rear end, respectively, of the plate 22. An accommodation space 25 is defined between the fixing portion 23 and the abutting portion 24 for receiving the protection bow 8. The abutting portion 24 is pivotably coupled to the plate 22 at a pivoting connection point 241, and the surface of the abutting portion 24 that faces the accomodation space 25 has a concave configuration with two abutment points 242. Thus, by using the pivot point 241 as a central pivoting axis, the abutting portion 24 can pivot about the plate 22 so that the abutment points 242 can function to contact two separate and spaced-apart locations along any curved surface, such as a surface along a protection bow 8. Two threaded bolts 26 can be threadably extended through corresponding bores in the fixing portion 23 and made to extend into the accommodation space 25 to contact the protection bow 8. When the bolts 26 contact the protection bow 8, the bolts 26 can slowly urge the protection bow 8 against the two abutment points 242 of the abutting portion 24. The user can even adjust the threaded bolts 26 (by threading in either direction) to loosen or tighten the grip of the bolts 26 and the abutting portion 24 on the protection bow 8 in the accomodation space 25. Thus, the grip provided by the two bolts 26 and the two abutment points 242 provide four fixing points in a single plane, which will ensure that the protection bow 8 is tightly secured in the accomodation space 25 and cannot be moved in any direction.

A cantilevered beam 298 can be attached to the main body 21, and a holding apparatus 299 can be carried by the beam 298, which functions as a holding arm. The holding apparatus 299 can be used to hold an indicating device (not shown).

Figure 3:
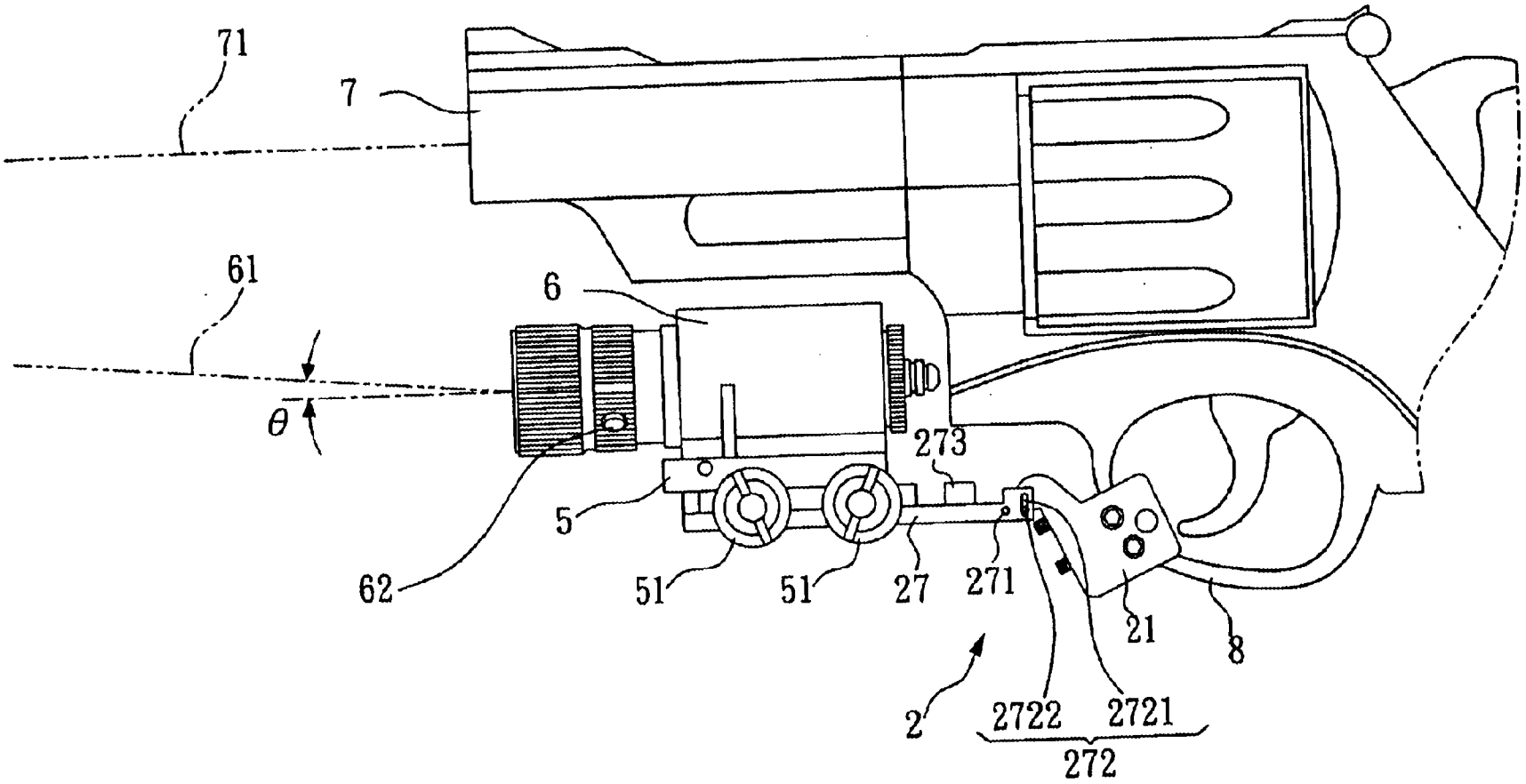
FIG. 3 is a side view illustrating how an indicating device can be used with the holding device of FIG. 2.

FIG. 3 illustrates how the holding device 2 of FIG. 2 can be used with a pistol accessory, such as an indicating device 6. The holding device 2 in FIG. 3 can be the same as the holding device 2 in FIG. 2. A rod-like swinging arm 27 is pivotably coupled to the main body 21 of the holding device 2 and has a pivoting connection 271 and a locking-and-fixing portion 272. The pivoting connection 271 can be a shaft that couples the rear end of the swinging arm 27 with an end of the main body 21 for pivoting movement with respect to each other. The locking-and-fixing portion 272 is spaced apart from the pivoting connection 271 and includes an open trough 2721 and a bolting lock 2722 that extends through the trough 2721 and the main body 21. With the pivoting connection 271 as a pivot point, the swinging arm 27 can be pivoted with respect to the main body 21. The pivoting of the swinging arm 27 causes the bolting lock 2722 to move up and down within the trough 2721, until the swinging arm 27 is oriented at a desired angle or position. The bolting lock 2722 can then be tightened to secure the swinging arm 27 at the desired angle or position.

A gliding seat 5 is coupled to the swinging arm 2 and has rotary wheels 51 that allow for sliding movement along the length of the swinging arm 27. The gliding seat 5 can be locked at specific positions along the swinging arm 27 by engaging one or more rotary wheels 51 in one or more spaces defined between pairs of flanges 273. An indicating device 6 is carried by the gliding seat 5, and functions to project a signal that represents an indication line 61 for providing a relative position of the trajectory 71 between a target and the barrel 7 of a pistol. The indicating device 6 is positioned between the swinging arm 27 and the barrel 7, so that the indicating device 6 can be positioned closely against the barrel 7 so that the indicating device 6 can be conveniently stored together with the pistol and its barrel 7 inside a holster. As shown in FIG. 3, the indicating line 61 and the trajectory 71 will form two parallel straight lines that are maintained at a certain distance apart from each other. However, the indicating line 61 can be adjusted by an angle (theta) by adjusting a bolting lock 62 on the indicating device 61, such that the indicating line 61 and the trajectory 71 will intersect at a crossing point. This crossing point can be used by the shooter when aiming at a target.

Thus, the relative position between the indicating device 6 and the barrel 7 can be adjusted in the following manner. First, the main body 21 is connected to the protection bow 8 according to the technique described above in connection with FIG. 2. Second, the swinging arm 27 can be pivoted with respect to main body 21 to the desired fixing angle, and this desired angle and orientation can be fixed by the locking-and-fixing portion 272 in the manner described above. Third, the gliding seat 5 is moved along the length of the swinging arm 27 and is secured at a desired fixed location along the swinging arm 27 by positioning the rotary wheels 51 between selected flanges 273.

Figure 4B:
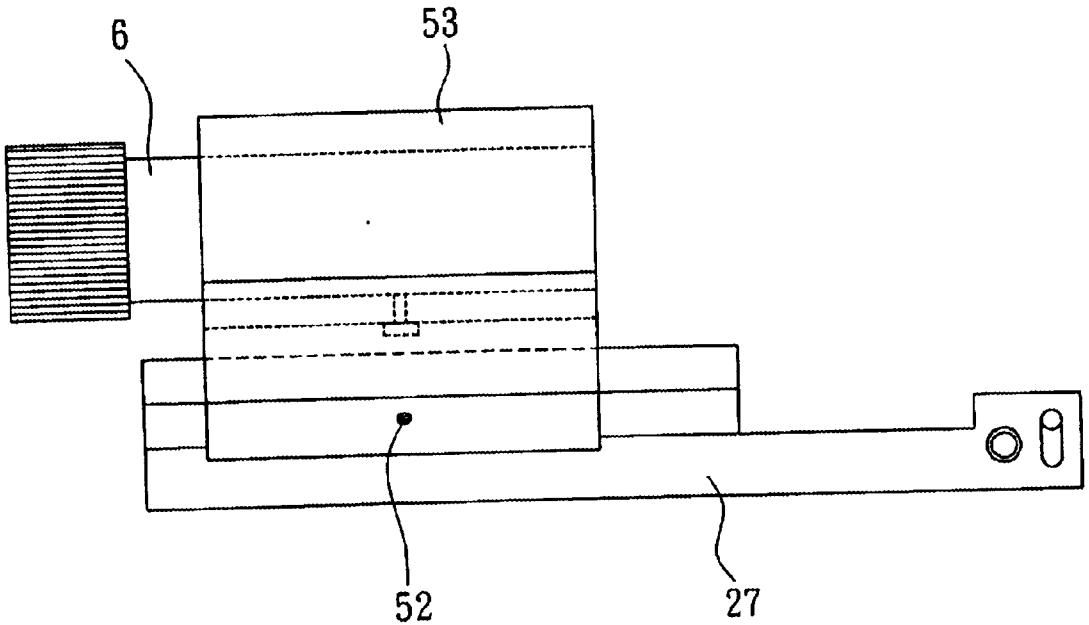
FIG. 4B is a side view illustrating the sliding connection of FIG. 4A.
Figure 4A:
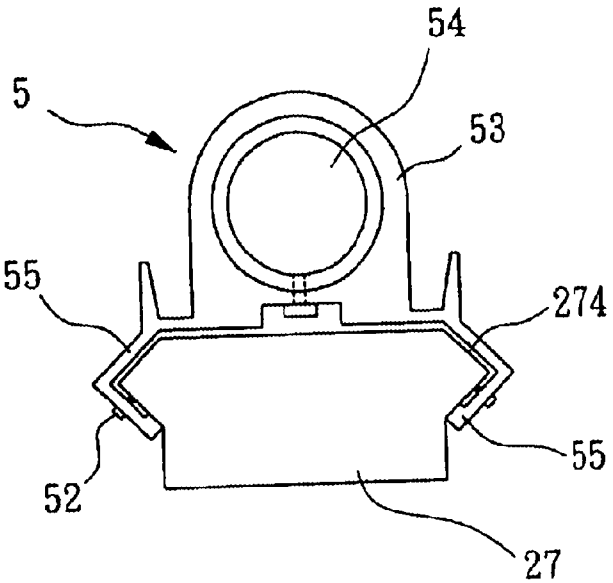
FIG. 4A is a cross-sectional view illustrating one embodiment of the sliding connection between the gliding seat and the swinging arm.

FIGS. 4A and 4B illustrate how the gliding seat 5 can be slidably coupled to the swinging arm 27. The swinging arm 27 can be configured to have two opposing V-shaped sides 274. The gliding seat 5 can have a barrel section 53 on its upper side that defines a through bore 54 for receiving the indicating device 6. The gliding seat 5 also has two lateral side rails 55, each having a V-shaped configuration that corresponds to the V-shaped configuration of the sides 274 on the swinging arm 27. As a result, the swinging arm 27 can be slidably moved inside the space defined by the rails 55, and the corresponding V-shape configurations of the rails 55 and the sides 274 allow for a secure but movable retention of the swinging arm 27 inside the gliding seat 5, yet also allows for the easy and convenient removal of the gliding seat from the swinging arm 27 (i.e., the user can merely slide the gliding seat 5 off the swinging arm 27). In addition, one or more threaded bolts 52 can be extended through the wall of the rails 55 to secure the gliding seat 5 at a desired fixed location along the length of the swinging arm 27.

Figure 5:
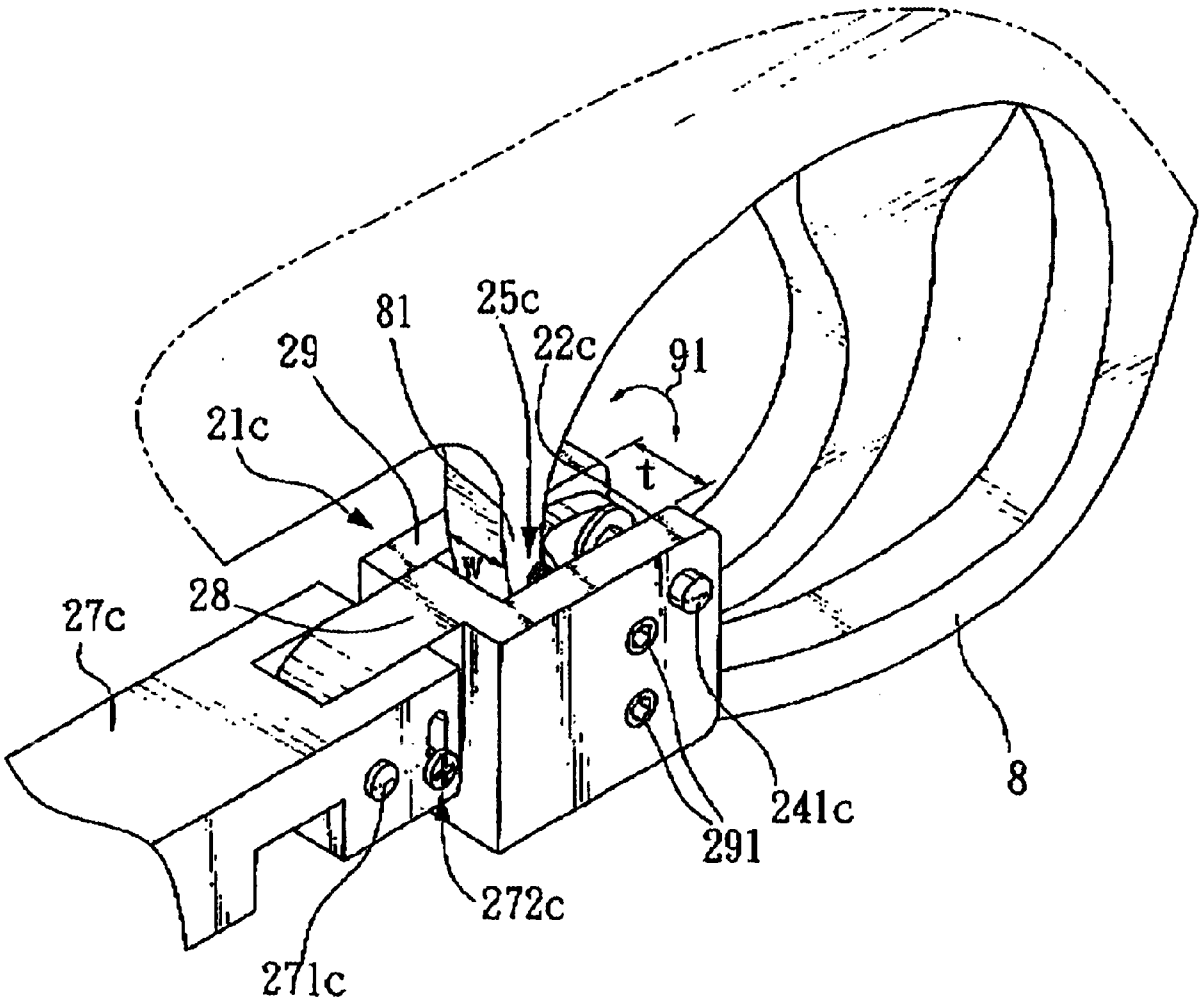
FIG. 5 is a perspective view illustrating how a holding device according to another embodiment of the present invention is secured to a protection bow of a trigger.

FIG. 5 illustrates another embodiment of a holding device for a protection bow. The holding device in FIG. 5 has a main body 21*c* (which can be identical to the main body 21 above), an extension 28 that extends at an offset step from the plate 22*c* of the main body 21*c*, and a lateral cover 29 that is parallel to the plate 22*c* of the main body 21*c*. The extension 28 has a thickness t which is also the same dimension of the space between the main body 21*c* and the lateral cover 29. The extension 28 can be formed in one piece with the main body 21*c*, or can be formed as a separate piece and then attached (e.g., by welding) to the main body 21*c*. The thickness t is preferably larger than the width w of the protection bow 8 of any pistol, so that the accomodation space 25*c* can receive the protection bow 8 from virtually any commercial pistol. Since the lateral cover 29 is parallel to the plate 22*c* of the main body 21*c*, the plate 22*c* and the lateral lid 29 are positioned at the two sides of the accommodation space 25*c*. The lateral cover 29 is pivotably coupled to the plate 22*c* by a pivot shaft 241 that defines the pivoting connection point. The lateral cover 29 rotates about the shaft 241*c* in the direction indicated by the arrow 91. To position the protection bow 8 inside the accomodation space 25*c*, the lateral cover 29 is first opened by rotating it about the shaft 241*c* in the direction of arrow 91 away from the extension 28, so that the protection bow 8 can be slid through the opening vacated by the pivoted lateral cover 29 and positioned in the accommodation space 25*c*. The lateral cover 29 is then rotated so that the lateral cover 29 is adjacent the extension 28 again (see the position shown in FIG. 5), thereby securing the protection bow 8 inside the accomodation space 25*c*. At least one locking-and-fixing bolt 291 (FIG. 5 shows two bolts 291) extends through corresponding openings in the plate 22*c*. The bolts 291 can be threaded in and out of the openings, and are therefore adapted to contact a side surface 81 of the protection bow 8, so as to urge the protection bow 8 against the lateral cover 29 to tightly secure the protection bow 8 inside the accomodation space 25*c*. To remove the protection bow 8 from the accomodation space 25*c*, the bolts 291 can be threaded to loosen their grip on the protection bow 8: The lateral cover 29 is then pivoted away from the extension 28 so that the protection bow 8 can be removed from the accomodation space 25*c*.

A swinging arm 27*c* having a pivoting connection 271*c* and a locking-and-fixing portion 272*c* can also be pivotably coupled to the extension 28. The swinging arm 27*c*, pivoting connection 271*c* and locking-and-fixing portion 272*c* can be the same as the corresponding elements 27, 271 and 272 described above, and function in the same manner.

Thus, the present invention provides a holding device for a protection bow of a trigger which provides sufficient locking and fixing strength to tightly secure the holding device to the protection bow, while allowing the user to use the holding device for different protection bows.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A pistol, comprising:

a protection bow having a side surface;

a holding device including:

a main body, a fixing portion and an abutting portion, and an accommodation space defined between the fixing portion and the abutting portion;

at least one bolt carried by the fixing portion and adjustably extending into the accomodation space;

wherein the abutting portion is pivotably connected to the main body at a pivot axis, and the abutting portion has an inner surface facing the accomodation space, the inner surface defining two spaced apart abutment points; and wherein the abutment points and the at least one bolt grip the protection bow when the protection bow is received inside the accommodation space.

2. A pistol comprising:

a protection bow having a side surface;

a holding device including:

a main body a, fixing portion and an abutting portion, and an accommodation space defined between the fixing portion and the abutting portion;

at least one bolt carried by the fixing portion and adjustably extending into the accomodation space;

wherein the abutting portion is pivotably connected to the main body at a pivot axis, and the abutting portion has an inner surface facing the accomodation space, the inner surface defining two spaced apart abutment points; and wherein the abutment points and the at least one bolt grip the protection bow when the protection bow is received inside the accommodation space; and further including a swinging arm that is pivotably connected to the main body about a pivot connection.

3. The pistol of claim 2, wherein the swinging arm has a locking-and-fixing portion that is spaced apart from the pivot connection.

4. The pistol of claim 2, further including a gliding seat movably connected to the swinging arm such that the gliding seat can experience linear displacement along the swinging arm.

5. The pistol of claim 4, wherein the swinging arm has a plurality of flanges that fix the gliding seat at a desired location along the swinging arm.

6. A pistol, comprising:

a protection bow having a side surface;

a holding device having a main body, a fixing portion, an abutting portion that is pivotably coupled to the main body, and an accommodation space defined between the fixing portion and the abutting portion for receiving the protection bow; and a swinging arm having a pivoting connection provided at one end of the swinging arm and pivotally connected to the main body, and a locking-and-fixing portion that is spaced apart from the pivoting connection portion.

7. The pistol of claim 6, further including a gliding seat movably connected to the swinging arm such that the gliding seat can experience linear displacement along the swinging arm.

8. The pistol of claim 7, wherein the swinging arm has a plurality of flanges that fix the gliding seat at a desired location along the swinging arm.

9. The pistol of claim 6, wherein the abutting portion is pivotably connected to the main body at a pivot axis, and the abutting portion has an inner surface facing the accomodation space, the inner surface defining two spaced apart abutment points.

10. The pistol of claim 9, wherein the holding device has at least one bolt carried by the fixing portion and adjustably extending into the accomodation space, and wherein the abutment points and the at least one bolt grip the protection bow when the protection bow is received inside the accommodation space.

* * * * *